US007187295B2

(12) United States Patent
Saltzek

(10) Patent No.: US 7,187,295 B2
(45) Date of Patent: Mar. 6, 2007

(54) SPORT FENCE

(76) Inventor: Klaus Saltzek, Pillauer Weg 12, Kaarst (DE) 41564

( * ) Notice: Subject to any disclaimer, the term of this patent is extended or adjusted under 35 U.S.C. 154(b) by 561 days.

(21) Appl. No.: 10/487,266

(22) PCT Filed: Aug. 21, 2002

(86) PCT No.: PCT/EP02/09339

§ 371 (c)(1),
(2), (4) Date: Feb. 19, 2004

(87) PCT Pub. No.: WO03/019507

PCT Pub. Date: Mar. 6, 2003

(65) Prior Publication Data

US 2004/0244034 A1 Dec. 2, 2004

(30) Foreign Application Priority Data

Aug. 21, 2001 (DE) ..... 101 40 902

(51) Int. Cl.
*G08B 3/00* (2006.01)

(52) U.S. Cl. ..... 340/691.1; 340/323 R; 340/331; 340/691.6; 40/598

(58) Field of Classification Search ..... 340/691.1, 340/323 R, 331, 332, 691.6; 40/598
See application file for complete search history.

(56) References Cited

U.S. PATENT DOCUMENTS 5,026,058 A 6/1991 Bromley
5,264,933 A * 11/1993 Rosser et al. ..... 348/578
5,402,988 A * 4/1995 Eisele ..... 256/24
5,491,517 A * 2/1996 Kreitman et al. ..... 348/581
5,543,856 A * 8/1996 Rosser et al. ..... 348/578
5,557,868 A 9/1996 Tabary et al.
5,833,549 A 11/1998 Zur et al.

FOREIGN PATENT DOCUMENTS

| | | | |
|---|---|---|---|
| CN | 85 1 05557 | A | 1/1987 |
| DE | 36 39 096 | A1 | 5/1988 |
| DE | 39 19 689 | A1 | 12/1990 |
| DE | 199 38 406 | A1 | 3/2001 |
| EP | 0 136 217 | A1 | 4/1985 |
| EP | 0 767 068 | A2 | 4/1997 |
| EP | 1 075 861 | A2 | 2/2001 |
| GB | 2 258 424 | A | 2/1993 |
| WO | PCT/EP2002/009339 | | 8/2002 |
| WO | PCT/EP02/09339 | | 1/2003 |
| WO | PCT/EP02/09339 | | 12/2003 |

* cited by examiner

*Primary Examiner*—Daryl C Pope
(74) *Attorney, Agent, or Firm*—Cook, Alex, McFarron, Manzo, Cummings & Mehler Ltd

(57) ABSTRACT

The invention relates to a sports hoarding having at least one contact sensor and at least one actuator with the actuator initiating an advertising message when the sensor produces a signal as a result of an impacting body.

17 Claims, 1 Drawing Sheet

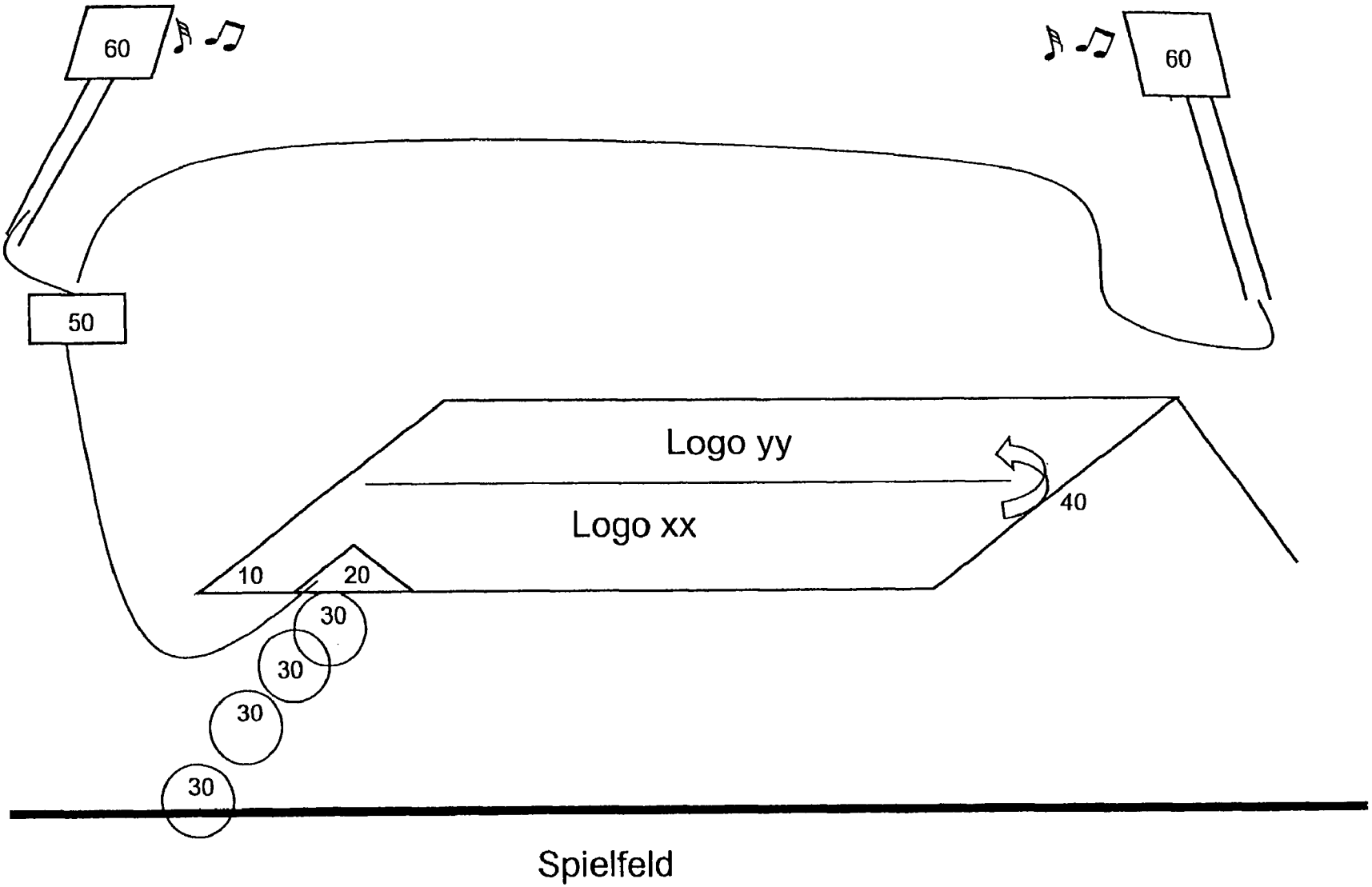
60
60
50
40
Logo yy
Logo xx
20
10
30
30
30
30
Spielfeld

SPORT FENCE

TECHNICAL FIELD

The invention relates to a sports hoarding, as is normally used in stadium advertising, and claims the priority of the German Patent Application 101 40 902.8-32, whose contents are referred to.

BACKGROUND AND PRIOR ART

Advertising represents a major component of many types of sports. In this case, in addition to advertising during pauses and shirt advertising, areas are preferably used which the spectator looks at when looking at the playing field. Playing field boundary hoardings in football, basketball or ice-hockey stadiums are thus provided with advertising messages.

Generally, these advertising hoardings have static images, symbols and writing or have a changing image, which is produced by a change, for example electronic image signals. In this case, these visual signals are changed at fixed time intervals. Since these intervals are independent of the progress of the game, the "advertising effect" is generally very low, since the spectator's attention is concentrated virtually entirely on the progress of the game and the advertising hoardings are perceived only as a background and, furthermore, there is a certain effect of becoming used to them. In sporting stadiums, the scoreboard is sometimes used as an advertising medium with dynamic advertising contents.

However, the spectator's attention is primarily directed at those involved in the sport and the sports bodies which are moved by those involved in the sport, such as the ball, frisbee, shot, hammer, discus or javelin. Particularly in the case of fast ball games, such as football, handball or volleyball, the view remains on the ball, whose movement determines the outcome of the game and which is followed by the camera for the television spectator.

It is known from other areas of advertising for the attention of those being addressed to be diverted by noises, movements or special effects on the advertising media.

It is also known for an acoustic addition to be provided for an advertising medium, by an external stimulus.

For example, the British Patent Specification 2 258 424 describes a poster with built-in sensors which can be activated by light, pressure or contact and then results in an audio medium being played back, which adds to the visual message on the hoarding in an appealing manner.

Mechanically triggered effects are also known from other areas.

For example, European Patent Specification 0 767 068 A3 discloses a game in which a mechanical sensor is activated by touching or pushing an image, as a result of which an electrical pulse allows a built-in audio medium to be played back.

Known measures in the sporting area are, however, restricted to the described hoarding and shirt advertising media, although the role of advertising in sport is of critical importance, and considerable sums are invested in advertising measures in the sporting area.

OBJECT OF THE INVENTION

The invention is now based on the object of providing an advertising medium for the sporting area, in particular for ball sports, which draws the attention of the spectator more strongly and thus provides a long-lasting impression relating to the advertised product.

THE INVENTION

The object is achieved by the independent claims. Advantageous refinements are the subject matter of the dependent claims.

The fundamental idea of the invention is that the attention of the spectator, which is directed at the moving sports object, such as a ball, frisbee, shot, hammer, discus or javelin, can surprisingly be directed at an advertising medium which reacts to the sports object. On the basis of the use according to the invention, this may be done by the sports object striking or flying past a sports hoarding, such as a side boundary hoarding on a football field, and in this way triggering an advertising message.

In this case, a "sports hoarding" is any type of flat body which is used around surfaces and areas for any types of sport. This also includes goal posts, for example a football goal. In addition, for the purposes of this invention, the expression sports hoardings also includes all other advertising media which are arranged such that a sports object may act on them (for example, an oversized refreshment drink behind the penalty area could trigger an advertising melody when a ball makes contact with it). The same applies to mounts for sensors which do not themselves represent an advertising medium intrinsically, but trigger an advertising medium.

Particularly in the case of sporting events with large numbers of spectators, advertising hoardings reach a very large number of recipients at the same time, and their effectiveness is therefore of considerable importance.

The advertising media which can be used according to the invention include static images and writing as well as variable images. In the case of hoardings with an automatic image sequence, the corresponding images can be played through in a similar way to that in the case of a film, for example via roller systems, triggered by means of an occurrence during the sporting event, and thus positioned in the image window. Another possibility for an actuator-switched image change is provided by moving or folding over individual image parts, which each have different advertising messages printed on their individual faces.

In addition, for example, writing can be reinforced by background lighting or by direct lighting or can be made visible only when a large number of lighting bodies, for example lamps, are switched on.

Furthermore, light-activated holograms or the activation of fluorescent images by means of electrical pulses represent possible ways to implement the invention by the triggering of an actuator signal when a sensor is activated.

A special advertising effect is achieved by a combination of visual and acoustic signals, in which case both the visual and the acoustic signals can be triggered via sensors.

In one preferred embodiment of the sports hoarding according to the invention, the hoarding has static image sections, in which case the impacting sports bodies can activate a sensor which can trigger the playback of audio, of a noise or of an advertising melody via a playback unit. This embodiment offers the advantage of adding to the normal visual advertising message with a technically simple design and, in particular, of linking it to an acoustic signal which can be called up.

In a further advantageous embodiment, the hoarding has an electronic image display in which case the sports body can also trigger a change or reinforcement of the displayed images, for example by briefly emphasizing them. For this purpose, the hoarding can be used to overlay an additional visual advertising message, for example a defined slogan appropriate to the company or product, an image or writing. The advantage of a hoarding with an electronic image display in conjunction with the invention is evident in particular from the capability for a rapid image change with an unlimited choice of images, as is required in order to increase the advertising effect when associated with fast sports. For this purpose, an image change in the form of a computer animation is particularly preferable—in particular for smooth transformation from one image to a second image (so-called morphing).

A further option is to use a changing hoarding. In this case, it is possible, for example, for the hoarding to be moved out of an appropriate recess in the ground, and to be retracted again. Alternatively, rotating hoardings are feasible, which are not extended or retracted but are revolved or folded over onto their second image side via a moving rotation axis, by means of a rotating apparatus. A rotating hoarding offers the advantage of overlaying changing images simply by means of rotation or extending and retracting the hoarding when the attention of the public is directed at the hoarding and not, as in the prior art, at a randomly determined time.

In an alternative embodiment, the advertising message or its reinforcement can be achieved by producing visual effects by means of lighting bodies (for example colored lamps), by background lighting, by activation of fluorescent images or by playing back images and image sequences mechanically.

In this case, it is particularly advantageous to combine visual and acoustic effects with one another in all of the described hoardings. In addition to the visual advertising messages which are the primary factor for rotating hoardings and hoardings with electronic image display, it is also in this case additionally possible to produce acoustic effects which, for example, announce, accompany or separate the image changes or the movement of the hoardings.

The expression "impacted body" covers not only those objects which are moved in the course of a sporting event but also the sports person who can trigger the sports hoarding with his or her foot or with some other part of the body. All types of balls that are used in games as well as objects that are thrown may be used, in particular for this purpose.

The sensor need not necessarily be triggered by contact, but can also be triggered visually, for example by means of a light barrier or some other optical sensor, or else an acoustic sensor. The moving sports body is preferably a football, handball, basketball, water polo ball, volleyball, tennis ball, a frisbee disk, a shot, a discus, a javelin, a hammer or a puck.

Any types of music may be used, in particular, as the acoustic signals which are triggered by the sensor activation, or else other noises, which preferably represent a sensible association with the respective product.

These may be natural noises (for example animal noises, wind and water noises, the noise of rain, etc.), technical noises (for example a car, engines, horns, squealing tires, a train, a tram, bell noises, crunching or clinking of glass, porcelain and metal, noises from domestic appliances, hammers, drills, alarms, noises from the opening of locks, bottles and cans, a typewriter, a washing machine, noises from rollers and blinds, a ticking clock, rockets, etc.), noises of a human origin (for example noises while eating, drinking, kissing, etc.) and all types of noises associated with sports.

The signals, in particular the acoustic signals, may be emitted via a sound production system which is connected directly to the hoarding, via the stadium loudspeakers or directly by coupling to electronic media (TV, radio, Internet, etc). The latter variant of signal production allows interference-free transmission of the information particularly to those looking at electronic receivers. Furthermore, it is feasible for the advertising message to be produced for the first time and only in the electronic media. For example, an optical sensor on the goal line of a football goal can trigger an advertising message on the television when a goal occurs. It is likewise feasible for a goal sensor such as this to trigger the sending of SMS or Internet messages to news groups of those interested in football. The same applies to corresponding groups for other types of sport.

A triggering of a visual and/or acoustic effect after contact with the hoarding in the sense of the invention is not restricted to material types of sport, but is also feasible for virtual types of sport, such as those encoded in computer games. A further preferred embodiment therefore relates to computer games in which an acoustic or visual advertising message is triggered when a digital or virtual object comes into contact with the sports hoarding. This virtual or digital object may, for example, be a football or some other sports body that is displayed on the computer screen.

The use of a sensor according to the invention for sports advertising may be of a different type; in one preferred embodiment, the contact sensor is used or, in the case of a computer game, an active playing area. As an alternative to a contact sensor, it is also possible to use an optical sensor. In this case, the sensor signal is not dependent on a direct collision between the hoarding and the sports body.

The invention can likewise be used in the form of so-called over labeling, in which, for example, specific hoardings on a playing field are digitally overwritten for television transmission, so that they produce a different advertising message in the television transmission than on the playing field. In this case, the invention may also be implemented by virtual contact or digital movement of the sports body to a specific area or in a specific area within or outside the playing field.

BRIEF DESCRIPTION OF THE INVENTION

The invention will be explained in more detail in the following text with reference to an exemplary embodiment which is illustrated in the drawing.

DETAILED DESCRIPTION OF A PREFERRED EMBODIMENT OF THE INVENTION

A rotating hoarding 10 is illustrated as the sports hoarding, in the form of an edge boundary of a football field. The recording of the mechanical impulse and the activation of the connected apparatuses resulting from this (rotation apparatus, playback appliance for the audio medium) are produced via the contact sensor 20. When a football 30 strikes the rotary hoarding 10, the latter is rotated by means of a rotation apparatus 40, as a result of which new writing can be seen on the hoarding 10. In the same way, the contact sensor 20 results in an advertising melody being played back via the playback appliance 50 and the stadium loudspeakers 60.

As the game progresses, the spectators follow the ball 30. If, as in the case of being "out of play", the ball 30 strikes the contact sensor 20, not only is the attention of the entire stadium and the television cameras directed in the area of the relevant hoarding at the time of the advertising message, but the game is also interrupted, so that this results in an intellectual free space for the spectators and viewers to perceive the advertising message.

The invention claimed is:

1. A method of generating a message comprising:

providing a side hoarding which is located outside the boundary lines of a playing filed;

providing at least one contact sensor (20) associated with said side hoarding, and at least one actuator as an advertising medium, whereby the sporting event is interrupted by a sports body crossing over the boundary line of the playing field, and, subsequently, an advertising message is transmitted by the actuator as soon as the sensor is actuated by the sports body.

2. The method as claimed in claim 1, using an image display with static image sections.

3. The method as claimed in claim 1, using an electronic image display.

4. The method as claimed in claim 1, using a changing or rotating hoarding (10).

5. The method as claimed in claim 1, with an image display, image change or image amplification by means of lighting bodies or fluorescent signals.

6. The method as claimed in claim 1, using mechanical, acoustic or visual triggering of the signal.

7. The method as claimed in claim 1, wherein means for producing acoustic advertising messages such as music, natural noises, technical noises, sporting noises or noises of human origin are provided.

8. The method as claimed in claim 1, wherein a sound production system which is connected to the sports or side hoarding (10) is provided.

9. The method as claimed in claim 1, wherein at least one stadium loudspeaker (60) which is connected to the hoarding (10) is provided.

10. The method as claimed in claim 1, wherein a sports hoarding which produces a digital or virtual display in a computer game is provided.

11. The method as claimed in claim 1, wherein the sound signal is not triggered by a sensor, but by a switch.

12. The method as claimed in claim 11, wherein a time switch is provided.

13. The method as claimed in claim 11, wherein a manual switch is provided.

14. The method as claimed in claim 11, wherein an automatic switch, which is activated when the hoarding advertisement changes, is provided.

15. A method of generating a message comprising:

providing a side hoarding which is located outside the boundary lines of a playing field;

providing at least one contact sensor (20) associated with said side hoarding, and at least one actuator as an advertising medium whereby the advertising message is transmitted to telecommunications media which are connected to the hoarding (10), in particular, broadcast radio, television, GSM, UMTS or the Internet.

16. The method as claimed in claim 15, wherein the sensor is a goal post sensor, goal line sensor or a corresponding success-related sensor for some other type of sport.

17. A method of generating a message comprising:

providing a side hoarding which is located outside the boundary lines of a playing field;

providing at least one contact sensor (20) associated with said side hoarding, and at least one actuator as an advertising medium, whereby providing at least one contact sensor (20) associated with said side hoarding, and at least one actuator as an advertising medium, whereby at least one acoustic transmission of the advertising message is executed.

* * * * *

UNITED STATES PATENT AND TRADEMARK OFFICE

CERTIFICATE OF CORRECTION

PATENT NO. : 7,187,295 B2
APPLICATION NO. : 10/487266
DATED : March 6, 2007
INVENTOR(S) : Klaus Saitzek It is certified that error appears in the above-identified patent and that said Letters Patent is hereby corrected as shown below:

On the title page item (76), correct the spelling of the surname of the inventor -- from "Klaus Saltzek" to --Klaus Saitzek--.

Signed and Sealed this

Eighth Day of May, 2007

JON W. DUDAS
*Director of the United States Patent and Trademark Office*